United States Patent [19]

Reed

[11] Patent Number: 4,953,849

[45] Date of Patent: Sep. 4, 1990

[54] RIDING CAPSULE DEVICE WITH CONTROL MECHANISM

[76] Inventor: Victoria K. Reed, 1778 Peck La., Cheshire, Conn. 06410

[21] Appl. No.: 437,746

[22] Filed: Nov. 17, 1989

Related U.S. Application Data

[63] Continuation-in-part of Ser. No. 922,942, Oct. 24, 1986.

[51] Int. Cl.[5] ..... G65G 1/00

[52] U.S. Cl. ..... 272/35; 272/33 A

[58] Field of Search ..... 272/33 R, 33 A, 35, 272/17–19

[56] References Cited

U.S. PATENT DOCUMENTS

| | | | |
|---|---|---|---|
| 2,935,316 | 5/1960 | Bradstreet | 272/17 |
| 3,451,673 | 6/1969 | Matson | 272/35 |
| 3,477,713 | 11/1969 | Cudmore | 272/33 A |

FOREIGN PATENT DOCUMENTS

| | | | |
|---|---|---|---|
| 54631 | 11/1934 | Denmark | 272/33 A |

*Primary Examiner*—Richard E. Chilcot, Jr.

*Attorney, Agent, or Firm*—CTC & Associates

[57] ABSTRACT

A riding capsule device includes a capsule member, a base, and control mechanism. The capsule member has a bottom configuration in the form of a convex spherical segment. The base has a lower portion with a top configuration in the form of a concave spherical segment engaged by said bottom configuration of the capsule member and having a radius of curvature which is larger than the radius of curvature of the bottom configuration of the capsule member. The base further has an upper portion with an internal concavely arcuate surface that forms a smooth continuation of and overlies the concave spherical segment of the bottom portion of the base. The control mechanism includes a circular, tubular control member that is inflatable and deflatable and which when inflated is doughnut shaped, and which is attached to the concavely arcuate surface of the upper base portion, and which, when inflated engages and immobilizes the capsule member, and which, when deflated, goes limp and disengages the capsule member.

6 Claims, 1 Drawing Sheet

RIDING CAPSULE DEVICE WITH CONTROL MECHANISM

RELATED APPLICATION

This application is a continuation-in-part of copending Application Ser. No. 922,942 filed Oct. 24, 1986.

BACKGROUND OF INVENTION

The present invention relates to an amusement device and more particularly to a riding capsule device with a control mechanism.

The copending application discloses a riding capsule device which includes a capsule member having a generally egg-shaped body with a convex exterior shape having a bottom configuration in the form of a convex spherical segment. The riding capsule device also has a base member with a flat bottom surface for stationary placement on a horizontal surface and a top configuration in the form of a concave spherical segment having a radius of curvature which is larger than the radius of curvature of the convex spherical segment. The spherical segments engage each other so that in use the capsule member can tilt and rotate with respect to the base member, under the impetus of an occupant of the capsule member, while confined thereby to a limited horizontal location.

The above-identified copending prior application also discloses braking means for preventing the tilting and rotation of the capsule member when desired. For example, when a user is attempting to get into or out of the capsule member, it is desirable that the capsule member be immobilized. The braking means disclosed in the prior application includes a plurality of braking members which are carried by the base member and are movable between retracted positions in which they do not protrude above the concave spherical segment and raised positions in which they do protrude thereabove and engage the convex spherical segment to immobilize the capsule member. Each braking member has teeth along one side thereof and the braking means further includes a gear associated with each braking member. Each gear has teeth which mesh with the teeth of its associated braking member and the gears are rotatable about their axes but are otherwise stationary. The braking means also includes a radio transmitting device within the capsule member, an on-off interlock switch within the capsule member and operable by an occupant of the capsule member, a radio receiving transmissions from the transmitting device, activation mechanism, external control switches and an electric motor for rotating the gears upon receipt of a signal from the transmitting device, initiated by the interlock switch or one of the internal switches.

The above-described braking means of the prior copending application is quite complex and relatively expensive.

Accordingly, it is an important object of the present application to provide a simplified and cheaper braking means than that of the prior copending application.

The foregoing and other objects and advantages of the present invention will become apparent hereinafter.

SUMMARY OF THE INVENTION

A riding capsule device according to the invention includes a capsule member, a base, and control mechanism, the capsule member having a bottom configuration in the form of a convex spherical segment, the base having a lower portion with a top configuration in the form of a concave spherical segment engaged by the bottom configuration of the capsule member and having a radius of curvature which is larger than the radius of curvature of said bottom configuration of said capsule member. The base further has an upper portion with an internal concavely arcuate surface that forms a smooth continuation of and overlies the concave spherical segment of the bottom portion of said base. The control mechanism includes a circular, tubular control member that is inflatable and deflatable and which when inflated is doughnut shaped, and which is attached to said concavely arcuate surface of said upper portion, and which, when inflated engages and immobilizes the capsule member, and which, when deflated, goes limp and disengages the capsule member.

DESCRIPTION OF THE INVENTION

Figure 1:
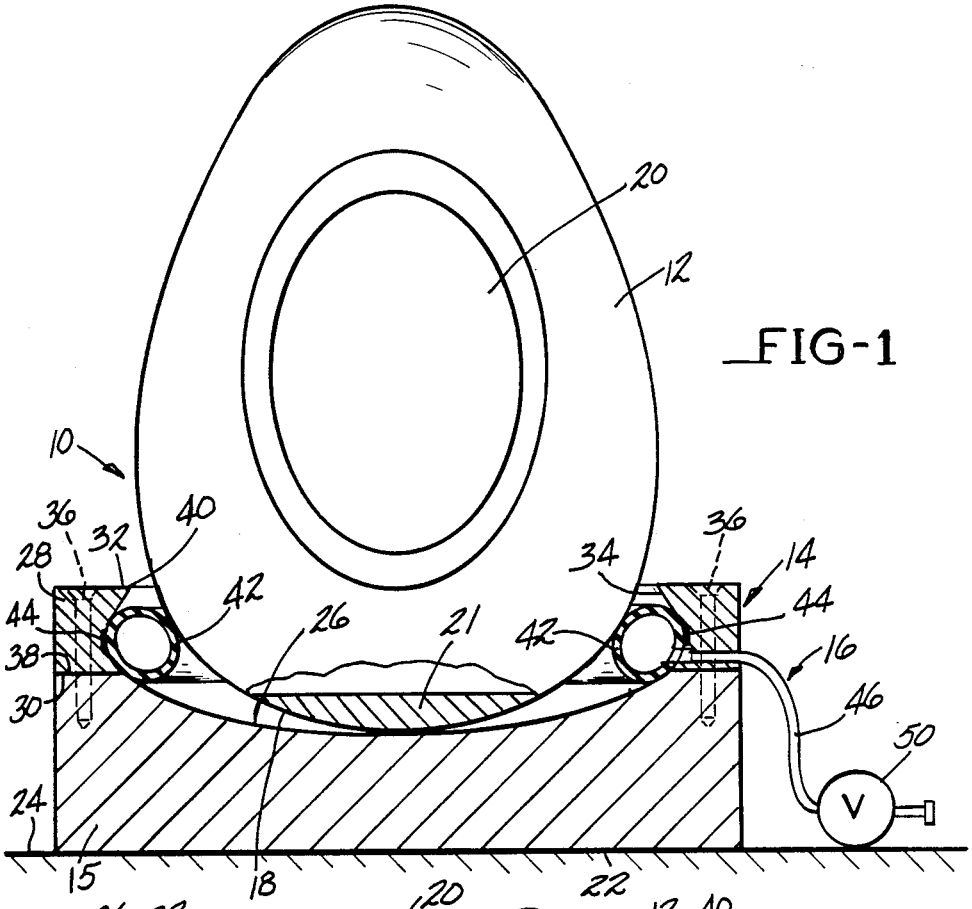
FIG. 1 is a front view of a riding capsule device embodying the invention, including a capsule member shown in elevation, a base member shown in section, and, also in section, control mechanism engaging the base member and inflated to support the capsule member.
Figure 2:
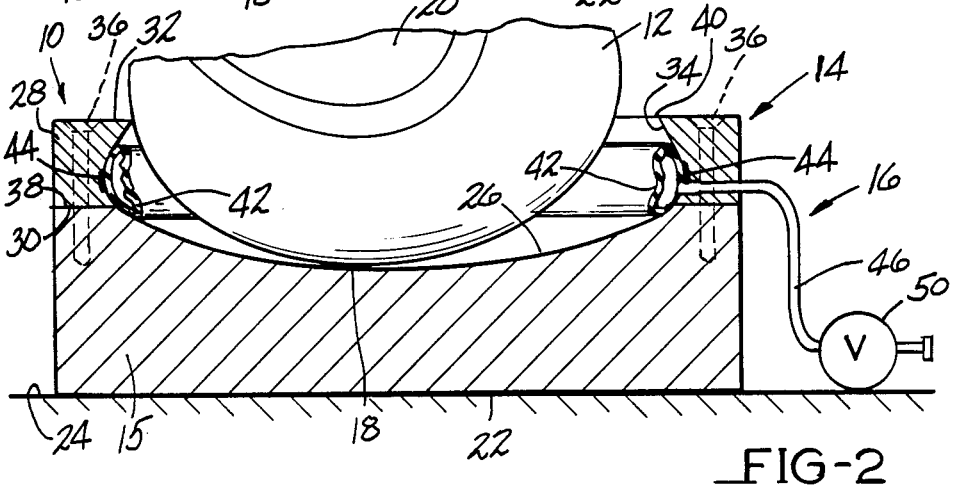
FIG. 2 is a fragmentary view similar to FIG. 1 but showing the control mechanism engaging the base member but deflated and not supporting the capsule member.

FIGS. 1 and 2 show a riding capsule device 10 embodying the invention. Device 10 includes a capsule member 12, a base 14 and control mechanism generally indicated at 16.

Capsule member 12 is generally egg-shaped and has a convex exterior configuration including a bottom configuration in the form of a convex spherical segment 18 of predetermined radius of curvature. Capsule member 12 also has an opening 20 in its upper portion, providing ingress and egress and a weighted base as indicated at 21 in FIG. 1.

Base 14 has a lower member or portion 15 which is symmetrical with respect to a vertical axis and has a flat bottom surface 22 which is shown resting on a horizontal surface 24, a top configuration in the form of a concave spherical segment 26 of predetermined radius of curvature that is greater than the predetermined radius of curvature of convex spherical segment 18. Convex spherical segment 18 is in engagement with concave spherical segment 26 of lower member 15, and by virtue of such engagement, capsule member 12 can tilt and rotate, under the impetus of its occupant, with respect to base 14, while confined thereby to a limited horizontal location, unless somehow prevented from doing so.

Base 14 also has an upper member or portion 28 in the form of a ring with a flat bottom surface 30, a flat top surface 32 parallel to surface 30, and an internal concavely arcuate surface 34 joining surfaces 30 and 32. Ring 28 is secured as by bolts 36 to lower member 15 with bottom surface 30 in flat engagement with a flat top surface 38 of member 15. Flat top surface 38 is parallel to bottom surface 22 and terminates concave spherical segment 26. Arcuate surface 34 provides a smooth continuation of concave spherical segment 26 and overlies the same, forming a lip. Arcuate surface 34 intersects surface 32 in a circle 40 having a radius such that when capsule member 12 is positioned with its axis coinciding with the axis of lower member 15, there is clearance between capsule member 12 and circle 40.

It is desirable that capsule member 12 be immobilized while someone is entering or leaving it, and that is the function performed by control mechanism 16.

Control mechanism 16 includes a circular, tubular control member 42 that is inflatable and deflatable. When member 42 is inflated it is doughnut shaped as shown in FIG. 1. It is of rubbery material and is attached as by cementing to arcuate surface 34 of ring 28, as indicated at 44, to maintain it in place.

When control member 42 is inflated, it engages the outer wall of capsule member 12 and immobilizes the same with its axis substantially vertical, as shown in FIG. 1.

When control member 42 is deflated, it goes limp, disengaging from capsule member 12, lying in a location more or less out of the way under the lip provided by arcuate surface 34, as shown in FIG. 2.

Control mechanism 16 further will be seen as including means for inflating and deflating control member 42, including an air hose 46 one end of which is operatively attached to the interior of control member 42. Hose 46 passes through a hole through the wall of upper member 28. The other end of hose 46 is operatively connected to a valve 50 outside capsule device 10 on horizontal surface 24.

When it is desired to immobilize capsule member 12, valve 50 is opened and compressed air is pumped from a source thereof (not shown) through valve 50, through hose 46 and into control member 42, inflating same to the FIG. 1 configuration in which capsule member 12 is immobilized, and valve 50 is shut.

When it is thereafter desired to permit capsule member 12 to rock, valve 50 is opened to permit control member 42 to deflate to the condition shown in FIG. 2.

It is apparent that the invention achieves the stated objects and advantages and others.

The disclosed details are exemplary only and are not to be taken as limitations on the invention except as those details may be included in the appended claims.

What is claimed is:

1. A riding capsule device including a capsule member, a base, and control mechanism, said capsule member having a bottom configuration in the form of a convex spherical segment, said base having a lower portion with a top configuration in the form of a concave spherical segment engaged by said bottom configuration of said capsule member and having a radius of curvature which is larger than the radius of curvature of said bottom configuration of said capsule member, said base further having an upper portion with an internal concavely arcuate surface that forms a smooth continuation of and overlies said concave spherical segment of said bottom portion of said base said control mechanism including a circular, tubular control member that is inflatable and deflatable and which when inflated is doughnut shaped, and which is attached to said concavely arcuate surface of said upper portion, and which, when inflated engages and immobilizes said capsule member, and which, when deflated, goes limp and disengages said capsule member.

2. A riding capsule device according to claim 1 wherein said control mechanism further includes means for inflating and deflating said control member.

3. A riding capsule device according to claim 2 wherein said means includes an air hose operatively attached to the interior of said control member, and a valve to which the other end of said air hose is operatively connected, whereby with said valve open compressed air can be pumped into said control member to inflate same against said capsule member and said valve can thereupon be closed to maintain said control member in the inflated condition, and said valve may be thereafter opened to deflate said control member.

4. A riding capsule device according to claim 1 wherein said upper and lower portions of said base are separate upper and lower members.

5. A riding capsule device according to claim 4 wherein one of said upper and lower members has a groove through its wall and said hose passes along said groove to the exterior of said base.

6. A riding capsule device according to claim 1 wherein said internal concavely arcuate surface provides a lip under which said control member lies when it is deflated.

* * * * *